US008286833B2

(12) United States Patent
Saidman et al.

(10) Patent No.: US 8,286,833 B2
(45) **Date of Patent: *Oct. 16, 2012**

(54) DISPENSING SYSTEMS FOR DISPENSING A HEATED LIQUID

(75) Inventors: Laurence B. Saidman, Duluth, GA (US); Daryl Reece, Atlanta, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/884,538

(22) Filed: Sep. 17, 2010

(65) Prior Publication Data

US 2011/0006082 A1 Jan. 13, 2011

Related U.S. Application Data

(63) Continuation of application No. 12/569,240, filed on Sep. 29, 2009, which is a continuation of application No. 11/748,765, filed on May 15, 2007, now Pat. No. 7,614,525, which is a continuation of application No. 10/282,573, filed on Oct. 29, 2002, now Pat. No. 7,617,951.

(60) Provisional application No. 60/352,397, filed on Jan. 28, 2002.

(51) Int. Cl.

| | |
|---|---|
| ***B67D 7/80*** | (2010.01) |
| ***B28B 5/00*** | (2006.01) |
| ***B05B 1/24*** | (2006.01) |
| ***F23D 11/10*** | (2006.01) |

(52) U.S. Cl. ..... 222/146.2; 222/146.5; 425/72.1; 239/135; 239/423

(58) Field of Classification Search ..... 222/146.2, 222/146.5, 129, 318; 425/72.1, 464; 239/132, 239/133, 134, 135, 423, 433

See application file for complete search history.

(56) References Cited

U.S. PATENT DOCUMENTS

| | | | | |
|---|---|---|---|---|
| 3,006,559 | A | | 10/1961 | Schmidt |
| 4,983,109 | A | * | 1/1991 | Miller et al. ..... 425/7 |
| 5,005,640 | A | * | 4/1991 | Lapinski et al. ..... 165/170 |
| 5,269,670 | A | | 12/1993 | Allen et al. |
| 5,368,233 | A | | 11/1994 | Brusko |
| 5,422,428 | A | | 6/1995 | McGuire et al. |

(Continued)

FOREIGN PATENT DOCUMENTS

| | | |
|---|---|---|
| DE | 8534594 | 2/1986 |

(Continued)

OTHER PUBLICATIONS

USPTO, Office Action issued in related U.S. Appl. No. 10/836,765 dated Aug. 31, 2011.

(Continued)

*Primary Examiner* — Kevin P Shaver
*Assistant Examiner* — Stephanie E Williams
(74) *Attorney, Agent, or Firm* — Wood, Herron & Evans, LLP

(57) ABSTRACT

Systems for dispensing heated liquids, such as hot melt adhesives. The dispensing system may include a hot air manifold and a liquid manifold with a surface confronting surfaces of the air manifold to define an air plenum. A dispensing module is coupled in fluid communication with the liquid manifold and in fluid communication with an air outlet of the hot air manifold. The dispensing module is capable of dispensing the heated liquid and is capable of receiving and dispensing the process air to impinge upon the heated liquid. A heating element is operative for heating the process air flowing through said air plenum.

10 Claims, 6 Drawing Sheets

U.S. PATENT DOCUMENTS

| | | | | |
|---|---|---|---|---|
| 5,429,840 | A | 7/1995 | Raterman et al. | |
| 5,445,509 | A | 8/1995 | Allen et al. | |
| 5,533,675 | A | 7/1996 | Benecke et al. | |
| 5,540,804 | A | 7/1996 | Raterman | |
| 5,556,471 | A | 9/1996 | Boccagno et al. | |
| 5,618,566 | A | 4/1997 | Allen et al. | |
| 5,620,139 | A | 4/1997 | Ziecker | |
| 5,700,322 | A | 12/1997 | Fort | |
| 5,823,437 | A | 10/1998 | Bolyard, Jr. | |
| 6,286,551 | B1 * | 9/2001 | Flatt et al. | 137/884 |
| 6,296,463 | B1 * | 10/2001 | Allen | 425/7 |
| 6,342,264 | B1 | 1/2002 | Raterman et al. | |
| 6,874,708 | B2 | 4/2005 | Reetz, III | |
| 7,059,545 | B2 | 6/2006 | Reetz, III | |
| RE39,399 | E | 11/2006 | Allen | |
| 2002/0139818 | A1 | 10/2002 | McGuffey | |
| 2003/0062384 | A1 | 4/2003 | McGuffey | |
| 2003/0168180 | A1 | 9/2003 | Saidman et al. | |
| 2004/0159672 | A1 | 8/2004 | Auber et al. | |
| 2004/0195378 | A1 | 10/2004 | Reetz | |
| 2005/0098654 | A1 | 5/2005 | Reetz | |
| 2005/0098655 | A1 | 5/2005 | Reetz | |
| 2005/0242108 | A1 | 11/2005 | Harris et al. | |
| 2007/0215718 | A1 | 9/2007 | Saidman | |
| 2010/0018996 | A1 | 1/2010 | Saidman | |
| 2011/0006082 | A1 | 1/2011 | Saidman et al. | |

FOREIGN PATENT DOCUMENTS

| | | | |
|---|---|---|---|
| EP | 0282748 | A1 | 9/1988 |
| EP | 0820817 | A2 | 1/1998 |
| EP | 0997200 | A1 | 5/2000 |
| EP | 1591167 | A1 | 11/2005 |
| JP | 06170308 | A | 6/1994 |
| JP | 07171465 | A | 7/1995 |
| JP | 08052388 | A | 2/1996 |
| JP | 08168703 | A | 7/1996 |
| JP | 10066922 | A | 3/1998 |
| JP | 2000070818 | A | 3/2000 |
| JP | 2001170540 | A | 6/2001 |
| JP | 2001293399 | A | 10/2001 |
| JP | 2002505951 | A | 2/2002 |
| JP | 2002512121 | A | 4/2002 |
| JP | 2003164786 | A | 6/2003 |
| JP | 2004243318 | A | 9/2004 |
| JP | 2004255374 | A | 9/2004 |
| JP | 2004344855 | A | 12/2004 |
| WO | 9401221 | A1 | 1/1994 |
| WO | 9718054 | A1 | 5/1997 |

OTHER PUBLICATIONS

USPTO, Office Action issued in related U.S. Appl. No. 12/159,008 dated Nov. 1, 2010.

European Patent Office, Search Report in EP 05 00 7249 Jun. 22, 2005, 3 pgs.

European Patent Office, European Search Report in EP Application Serial No. 03000838, Apr. 27, 2007.

European Patent Office, International Search Report and Written Opinion in PCT Application Serial No. PCT/US2006/049418, May 14, 2007.

Nordson Corporaton, Precision with Flexibility, The CF800M Metered Head, Trends, 1993.

US Patent and Trademark Office, Office Action issued in related U.S. Appl. No. 10/282,573, dated Dec. 11, 2008 (7 pages).

European Patent Office, European Search Report issued in related European Patent Application No. 10177926.2 dated Nov. 8, 2010.

European Patent Office, European Search Report issued in related European application No. 10191510.6 dated Jan. 26, 2011.

European Patent Office, European Search Report in European Application No. 10191176, Mar. 10, 2011.

European Patent Office, European Search Report in European Application No. 10191188, Mar. 10, 2011.

European Patent Office, European Search Report in European Application No. 10191181, Mar. 10, 2011.

European Patent Office, European Search Report in European Application No. 10177926, Nov. 16, 2010.

USPTO, Final Office Action issued in related U.S. Appl. No. 10/836,765 dated Jun. 29, 2010.

USPTO, final Office Action issued in related U.S. Appl. No. 12/159,008 dated Jun. 14, 2011.

Notice of Allowance issued in related U.S. Appl. No. 12/569,240 dated Feb. 29, 2012.

USPTO, Notice of Allowance issued in related U.S. Appl. No. 12/569,240 dated Nov. 7, 2011.

Japanese Patent Office, Office Action in Japanese Patent Application No. 2005-130653 dated Jun. 29, 2011; 2 pages.

USPTO, Office Action issued in related U.S. Appl. No. 10/836,765 dated Jan. 19, 2012.

* cited by examiner

DISPENSING SYSTEMS FOR DISPENSING A HEATED LIQUID

CROSS REFERENCE TO RELATED APPLICATIONS

This application is a continuation of application Ser. No. 12/569,240, filed Sep. 29, 2009, which is a continuation of application Ser. No. 11/748,765, filed May 15, 2007, now U.S. Pat. No. 7,614,525, which is a continuation of application Ser. No. 10/282,573, filed Oct. 29, 2002, now U.S. Pat. No. 7,617,951, which claims the benefit of U.S. Provisional Application Ser. No. 60/352,397, filed Jan. 28, 2002. The disclosure in each of these documents is hereby incorporated by reference herein in its entirety.

BACKGROUND

The invention relates to liquid dispensing systems and, in particular, to dispensing systems for dispensing a heating liquid.

Dispensing systems are used in numerous manufacturing production lines for dispensing heated liquids onto a substrate at specified application temperatures. Often, the dispensing system must discharge the heated liquid within a precise, elevated temperature range, such as in the dispensing of hot melt adhesives. Certain hot melt adhesive dispensing systems include a bank of individual dispensing modules or applicators that have a nozzle and an internal valve assembly for regulating liquid flow through the nozzle. Often, the valve assembly includes a valve seat engageable by a movable valve stem for flow control purposes.

The dispensing modules are typically heated to a desired adhesive application temperature such as by being directly connected to a heated manifold. In addition, a flow of heated process air is provided to the vicinity of the adhesive discharge outlet or nozzle. The heated process air is used for modifying a characteristic of the dispensed hot melt adhesive. For example, hot air streams can be angularly directed onto the extruded stream of hot melt adhesive to create one of various different patterns on the substrate, such as an irregular back-and-forth pattern, a spiral, a stitch pattern, or one of a myriad of other patterns. To form the pattern, the hot air stream imparts a motion to the discharged stream, which deposits continuously as a patterned bead on a substrate moving relative to the stream. As another example, the heated process air may be used to attenuate the diameter of the molten adhesive stream.

The heated process air also maintains the temperature of the nozzle at the required adhesive application temperature so that the hot melt adhesive will perform satisfactorily. If the nozzle is too cool, the hot melt adhesive may cool down too much just prior to discharge. The cooling may adversely affect the liquid cut-off at the nozzle when the valve stem is closed so that accumulated hot melt adhesive in the nozzle can drip or drool from the dispensing module. Often, this dispenses hot melt adhesive in unwanted locations such as, for example, in undesirable locations on the substrate or on the surrounding equipment and reduces edge control for the adhesive bead desired for intermittent dispensing applications. Furthermore, if hot melt adhesive exits the nozzle at a reduced temperature, the reduction in temperature can compromise the quality of the adhesive bond.

Conventional hot air manifolds employed in adhesive dispensing systems consist of a metal block having an interconnected network of internal air passageways and one or more heating elements. Process air is introduced into an inlet of the network and is distributed by the various air passageways to a set of outlets. Each outlet provides heated process air to an individual dispensing module. The heating elements heat the metal block by conductive heat transfer, and the surfaces of the internal air passageways, in turn, transfer heat energy to the process air circulating in the network. The heat energy heats the process air to a desired process temperature.

Conventional hot air manifolds are machined for a specific dispensing application. To place the outlets at desired locations, bores creating the air passageways must be machined as cross-drilled passages having precise inclination angles between two sides of the distribution manifold. The pattern of bores is challenging to design and complex to create. In addition, the pattern of outlets cannot be altered for accommodating differing numbers of dispensing modules or for adjusting the spacing between adjacent ones of the dispensing modules. In addition, because a single hot air manifold serves all of the modules, it is difficult if not impossible to individually adjust a property of the heated air, such as flow rate, provided to individual ones of the dispensing modules.

The introduction of modular adhesive manifolds for hot melt adhesive dispensing systems has provided a heretofore unsatisfied need for a modular hot air manifold. Conventional hot air manifolds that distribute heated process air to multiple outlets are not well suited for modular adhesive dispensing systems. In fact, conventional hot air manifolds actually reduce the key advantage of such systems since the hot air manifold cannot accommodate differing numbers of module adhesive manifolds (for changing the number of dispensing modules).

Thus, a hot air manifold is needed that has reduced dimensions and that can be dedicated to individual dispensing modules among those modules in a bank of dispensing modules. In particular, a hot air manifold is required for use with modular adhesive dispensing systems. A system is also needed for dispensing liquids with the assistance of process air.

SUMMARY OF THE INVENTION

Embodiments of the invention are directed to a dispensing system that includes a hot air manifold device of reduced dimensions and compliant with modular heated liquid dispensing applications. Embodiments of the invention also provide a dispensing system for use in non-modular adhesive dispensing applications that permits individual air adjustment for each dispensing module.

In one embodiment, the dispensing system includes a liquid manifold capable of supplying heated liquid and a dispensing module coupled in fluid communication with the liquid manifold. The dispensing module is capable of dispensing heated liquid received from the liquid manifold onto the substrate. The dispensing system further includes a hot air manifold with an air plenum and a flat heater positioned within the air plenum. An air inlet of the air plenum is capable of receiving process air and an air outlet of the air plenum is coupled in fluid communication with the dispensing module. The flat heater is operative for transferring heat to process air flowing from the air inlet to the air outlet. In certain embodiments, the flat heater may include a thick film resistive heating element.

In another embodiment, a dispensing system includes a liquid manifold capable of supplying heated liquid and a dispensing module coupled in fluid communication with the liquid manifold. The dispensing module is capable of receiving heated liquid from the liquid manifold and dispensing heated liquid from the nozzle onto the substrate. The dispensing system further includes a hot air manifold including a body with an air plenum and a heating element within the body. The air plenum has an air inlet capable of receiving process air and an air outlet coupled in fluid communication with the nozzle. The heating element is operative for heating process air flowing from the air inlet to the air outlet. The air plenum is dimensioned to produce a pressure drop of the process air between the air inlet and the air outlet of less than about 10% of the initial pressure at the air inlet.

In yet another embodiment, a modular dispensing system is provided for dispensing a heated liquid from a plurality of nozzles onto a substrate. The modular dispensing system comprises a plurality of manifold segments and a plurality of dispensing modules. Each of the manifold segments has a supply passage and a distribution passage and is configured to supply a flow of heated liquid from the supply passage to the distribution passage. The manifold segments are interconnected in side-by-side relationship so that the supply passages are in fluid communication. Each of the dispensing modules has a liquid passageway coupled in fluid communication with the distribution passage of a corresponding one of the adhesive manifolds for receiving the flow of the heated liquid. Each dispensing module is operative for dispensing heated liquid from one of the nozzles onto the substrate. The modular dispensing system further includes a plurality of hot air manifolds each respectively coupled to a corresponding one of the dispensing modules. Each hot air manifold includes an air plenum having an air inlet capable of receiving process air and an air outlet and a heating element operative for heating process air flowing from the air inlet to the air outlet. The air outlet of each hot air module is coupled in fluid communication with a corresponding one of the nozzles.

In another embodiment of the invention, a hot air manifold is provided for a modular dispensing system having a plurality of modular manifold segments, a plurality of dispensing modules, and a plurality of nozzles. Each dispensing module is coupled in fluid communication with a corresponding one of the modular manifold segments so as to receive heated liquid received and coupled in fluid communication with a corresponding one of the nozzles for dispensing heated liquid therefrom. The hot air manifold includes a body with a heating element, an air inlet capable of receiving process air, an air outlet adapted to be coupled in fluid communication with a corresponding one of the nozzles, and an air plenum extending from the air inlet to the air outlet. The heating element is operative for heating process air flowing from the air inlet to the air outlet. The air plenum is dimensioned to create a pressure drop of the process air between the air inlet and the air outlet of less than about 10% of the initial pressure at the air inlet.

In another embodiment of the invention, a hot air manifold is provided for a modular dispensing system having a plurality of adhesive manifold segments and a plurality of dispensing modules in which each dispensing module is operatively attached to and coupled in fluid communication with a corresponding one of the adhesive manifold segments. The hot air manifold comprises a hot air manifold body having an air inlet adapted to be coupled in fluid communication with a process air supply, an air outlet adapted to be coupled in fluid communication with only one of the dispensing modules, and an air passage extending from the air inlet to the air outlet. The manifold further includes a flat heater positioned within the air passage and operative for heating process air flowing from the air inlet to the air outlet.

In another embodiment of the invention, a hot air manifold is provided for a modular dispensing system having a plurality of modular manifold segments, a plurality of dispensing modules, and a plurality of nozzles. Each dispensing module is coupled in fluid communication with a corresponding one of the modular manifold segments so as to receive heated liquid received and coupled in fluid communication with a corresponding one of the nozzles for dispensing heated liquid therefrom. The hot air manifold comprises a body including an air inlet adapted to be coupled in fluid communication with a process air supply, an air outlet adapted to be coupled in fluid communication with only one of the dispensing modules, an air plenum extending from the air inlet to the air outlet, and a heating element in thermal contact with the body. The heating element is operative for heating process air flowing in the air plenum from the air inlet to the air outlet.

The embodiments of the invention dramatically reduce the exterior dimensions of hot air manifolds used in the dispensing of heated adhesives. The hot air modules of the invention increase the efficiency of the heat transfer from the heating elements to the process air and do so in a body of reduced dimensions without introducing a significant pressure drop in the air passageways of the module. The hot air modules of the invention also improve the control over the temperature of the exhausted process air, especially for relatively high air flow rates, and are highly responsive to changes in the temperature of the associated heating elements. The hot air modules of the invention are readily adaptable to modular adhesive dispensing applications, as an individual hot air manifold can be provided for each adhesive manifold module and dispensing module in a bank of dispensing manifolds and modules.

The hot air modules of the invention are also useful in non-modular systems having conventional adhesive manifolds because each can provide heated process air to an individual dispensing module attached to the conventional adhesive manifold. In particular, the hot air modules of the invention allow the air pressure, flow rate, and/or perhaps air temperature to be individually adjusted among the dispensing modules in multi-stream dispensing systems having either modular or conventional adhesive manifolds. Furthermore, because each hot air module is dedicated to one dispensing module, a high degree of control over the characteristics of the heated process provided to each dispensing module is simply provided. For example, a flow control device, such as a needle valve, can be installed on the air inlet to each hot air manifold so that the pressure and flow rate are easily and individually adjustable for each dispensing module, whether served by a unique process air source or by a common hot air manifold.

In yet another embodiment, a process air-assisted dispensing system is provided for dispensing a liquid. The process air-assisted dispensing system includes a liquid manifold, a first dispensing module connected with the liquid manifold, a second dispensing module connected with the liquid manifold, a first nozzle connected with the first dispensing module, and a second nozzle connected with the second dispensing module. The second dispensing module is positioned in a side-by-side relationship with the first dispensing module across the width of the dispensing system. The first nozzle is capable of dispensing the liquid and is also capable of dispensing the process air toward the liquid dispensed from the first nozzle to impart a motion to the liquid. The second nozzle is capable of dispensing the liquid and capable of dispensing the process air toward the liquid dispensed from the second nozzle to impart a motion to the liquid. A hot air manifold, which is capable of receiving the process air, is coupled in fluid communication with the first and second nozzles. The process air-assisted dispensing system further includes a control operative to independently control a characteristic of the process air dispensed by the first nozzle compared to the same characteristic of the process air dispensed by the second nozzle.

In yet another embodiment, a dispensing system is provided for dispensing a heated liquid onto a substrate. The dispensing system includes a hot air manifold with a first surface, a second surface recessed in the first surface to define an air plenum for process air, a first passageway defining an inlet for supplying the process air to the air plenum, and a second passageway defining an outlet for removing the process air from the air plenum. The dispensing system further includes a liquid manifold capable of supplying heated liquid, the liquid manifold including a surface confronting the first and second surfaces of the hot air manifold. The surface of the liquid manifold is separated from the second surface of the hot air manifold by a distance ranging from about 5 mils to about 30 mils to define a height of the air plenum. A dispensing module is coupled in fluid communication with the liquid manifold and in fluid communication with the air outlet of the hot air manifold. The dispensing module is capable of dispensing the heated liquid received from the liquid manifold onto the substrate. The dispensing module is also capable of receiving the process air from the second passageway of the hot air manifold and dispensing the process air to impinge upon the heated liquid. A heating element is operative for heating the process air flowing through the air plenum from the inlet to the outlet.

In yet another embodiment, a dispensing system is provided for dispensing a heated liquid onto a substrate. The dispensing system includes a plurality of hot air manifolds, a plurality of manifold segments, a plurality of dispensing modules, and a plurality of heating elements. Each hot air manifold includes a first surface, a second surface recessed in the first surface to define an air plenum for process air, a first passageway defining an inlet for supplying the process air to the air plenum, and a second passageway defining an outlet for removing the process air from the air plenum. Each manifold segment has a supply passage and a distribution passage coupled with the supply passage. Each manifold segment is configured to supply the heated liquid from the supply passage to the distribution passage. The manifold segments are interconnected in side-by-side relationship so that the supply passages are in fluid communication. Each of the manifold segments includes a surface confronting the first and second surfaces of a respective one of the hot air manifolds. The surface of the manifold segment is separated from the second surface of the hot air manifold by a distance ranging from about 5 mils to about 30 mils to define a height of the air plenum. Each dispensing module is coupled in fluid communication with the distribution passage of a respective one of the manifold segments and in fluid communication with the outlet of a respective one of the hot air manifolds. Each dispensing module is capable of dispensing the heated liquid received from the respective one of the manifold segments onto the substrate. Each of the dispensing module is also capable of receiving the process air from the second passageway of the respective one of the hot air manifolds and dispensing the process air to impinge upon the heated liquid. The dispensing system further includes a plurality of heating elements each operative for heating the process air flowing through the air plenum of a respective one of the hot air manifolds from its air inlet to outlet.

BRIEF DESCRIPTION OF THE DRAWINGS

Various advantages, objectives, and features of the invention will become more readily apparent to those of ordinary skill in the art upon review of the following detailed description of the preferred embodiments, taken in conjunction with the accompanying drawings.

DETAILED DESCRIPTION

Although the embodiments of the invention will be described next in connection with certain embodiments, the invention is not limited to practice in any one specific type of adhesive dispensing system. Exemplary adhesive dispensing systems in which the principles of the invention can be used are commercially available, for example, from Nordson Corporation (Westlake, Ohio) and such commercially available adhesive dispensing systems may be adapted for monitoring the application process in accordance with the principles of the invention. The description of the invention is intended to cover all alternatives, modifications, and equivalent arrangements as may be included within the spirit and scope of the invention as defined by the appended claims. In particular, those skilled in the art will recognize that the components of the invention described herein could be arranged in multiple different ways.

Figure 1:
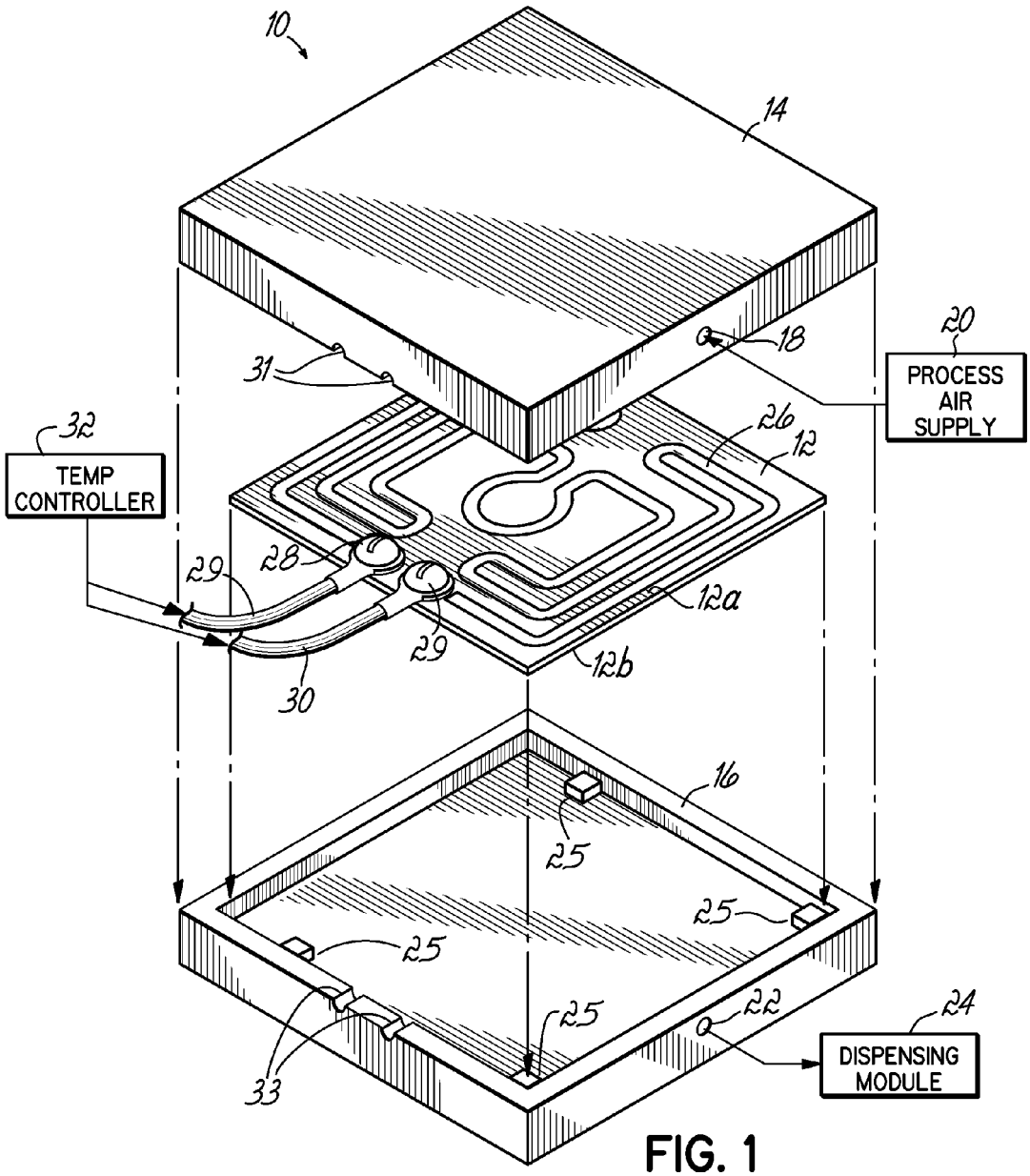
FIG. 1 is an exploded perspective view of a hot air module according to an embodiment of the invention.
Figure 2:
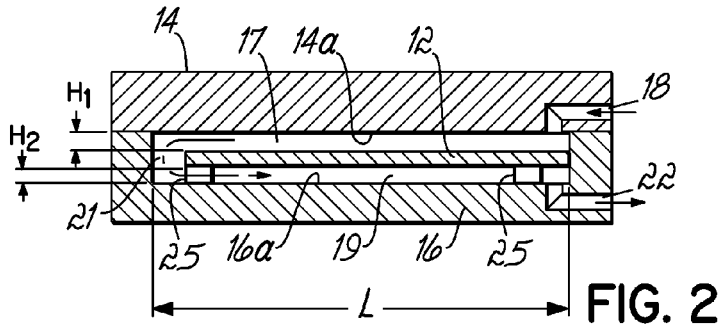
FIG. 2 is a cross-sectional view of the hot air module of FIG. 1 as assembled.

With reference to FIGS. 1 and 2, a hot air module or manifold 10, according to the principles of the invention, generally includes a flat or planar heater 12 enclosed in an outer housing consisting of an upper housing half 14 and a lower housing half 16. The upper housing half 14 includes an air inlet 18 that is adapted to be coupled in fluid communication with a process air supply 20. The lower housing half 16 includes an air outlet 22 that is adapted to be coupled in fluid communication with a heated air inlet (not shown) of a dispensing module 24 and a support structure supplied by supports 25 for elevating the heater 12 above the base of the lower housing half 16. Alternative support structures for heater 12 are contemplated by the invention, such as a lip extending partially about the inner circumference of the lower housing half 16.

With reference to FIG. 2, when assembled, the flat heater 12 divides space inside the assembled housing halves 14, 16 into an upper air passageway or air plenum 17 and a lower air passageway or air plenum 19 coupled in fluid communication by a connecting passageway in the form of a vertical connecting or side air passageway 21. Side air passageway 21 is provided by a gap between the flat heater 12 and housing halves 14, 16 and is located at one end of the housing opposite to the other end that incorporates air inlet 18 and air outlet 22. Supports 25 space the flat heater 12 to aide in defining the height of the lower air plenum 19 and may be provided on housing half 14, if needed, to define the height of the upper air plenum 17. Additional flat heaters, each similar to flat heater 12, may be provided in the space inside the housing halves 14, 16 and configured to provide multiple stacked air plenums for passing the process air across multiple heated surfaces. Such a configuration increases the effective heating path for the hot air manifold 10 while retaining a compact size. The two air plenums 17, 19 and side air passageway 21 collectively define an air plenum or passageway of larger effective dimensions.

The flat heater 12 may be any flat, two-dimensional heater having the desired air heating ability and sized to be positioned within the housing halves 14, 16. Typically, the flat heater 12 must have the ability to heat the process air discharged from air outlet 22 to a process temperature between about 250° F. and about 450° F. To that end, the flat heater 12 must have an area and a power density adequate to heat the process air to the desired process temperature. The flat heater 12 is illustrated in FIGS. 1 and 2 as a resistive heater consisting of a substrate material, such as a stainless steel, and a multi-layer, thick-film heating element 26 that incorporates an electrically-isolated resistor commonly formed from rare earth metals suspended in a glass matrix. Thick film heating element 26 provides a high thermal or temperature uniformity across the heated upper and lower surfaces 12*a*, 12*b* of heater 12 and, due to its low thermal mass, is highly responsive to variations in input power. Exemplary flat heaters 12 suitable for use in the hot air manifold 10 of the invention are commercially available from Watlow Electric Manufacturing Company (St. Louis, Mo.).

The heating element 26 includes a pair of stud terminations 27, 28 that are connected by conventional power transmission cables 29, 30 to a temperature controller 32. The power transmission cables 29, 30 are sealingly captured within a pair of openings provided by semicircular notches 31 in the upper housing half 14 that are registered with corresponding ones of semicircular notches 33 in the lower housing half 16 when the housing halves 14, 16 are mated. The temperature controller 32 is operative for providing electrical energy that is resistively dissipated by the heating element 26 to produce thermal energy used for heating the process air flowing from air inlet 18 to air outlet 22. The flat heater 12 or one of the housing halves 14, 16 may be provided with a conventional temperature sensor (not shown), such as a resistance temperature detector (RTD), a thermistor or a thermocouple, for sensing the temperature of heater 12 and for providing a feedback signal for use by the temperature controller 32 in regulating the temperature of the flat heater 12.

In use and as best shown in FIG. 2, air inlet 18 receives a flow of process air from process air supply 20, which passes serially through upper air plenum 17, side air passageway 21 and lower air plenum 19 and exits through air outlet 22. Heat energy is transferred from flat heater 12 to the process air flowing in the plenums 17, 19. The inwardly-facing surfaces 14*a*, 16*a* of the housing halves 14, 16 are also heated by flat heater 12 and are capable of transferring heat energy to the process air flowing in plenums 17, 19. Configuring the hot air manifold 10 so that the process air passes twice proximate to or across each of the heated upper and lower surfaces 12*a*, 12*b* of flat heater 12 in transit from air inlet 18 to air outlet 22 optimizes the heat transfer efficiency while minimizing the overall dimensions of housing halves 14, 16. However, it is contemplated by the invention that the hot air manifold 10 may be configured so that the process air passes proximate to only one of the heated upper and lower surfaces 12*a*, 12*b* of flat heater 12.

Each of the air plenums 17, 19 is generally shaped as a parallelepiped open space having a rectangular cross-section when viewed normal to any face of the parallelepiped and having rectangular dimensions consisting of a length L and a width (into and out of the plane of the page of FIG. 2). The height, $H_1$, of air plenum 17 is defined by the perpendicular separation between heated upper surface 12*a* and inwardly-facing surface 14*a*. The height, $H_2$, of air plenum 19 is defined by the perpendicular separation between heated lower surface 12*a* and inwardly-facing surface 16*a*. Each of the plenums 17, 19 may have identical rectangular dimensions, although the invention is not so limited. The dimensions of air plenums 17, 19 are selected to provide efficient heat transfer with an acceptable pressure drop between the air inlet 18 and air outlet 22. Given the magnitude of one dimension, the magnitudes of the remaining dimensions, which provide efficient heat transfer and acceptable pressure drop, may be calculated mathematically as indicated herein. Typically, a pressure drop of no more than about 10% of the air pressure at the air inlet 18 is desired in the flow path between the air inlet 18 and air outlet 22. To achieve such performance with a length of less than about 5 inches and a width of less than about 1 inch, the height of each of the air plenums 17, 19 should be in the range of about 5 mils to about 20 mils and may be as large as 30 mils. The dimension of side air passageway 21 in a direction parallel to the length of the air plenums 17, 19 is substantially equal to the height of the air plenums 17, 19. The dimension of side air passageway 21 in a direction into and out of the plane of the page of FIG. 2 is substantially equal to the width of the air plenums 17, 19.

Figure 3:
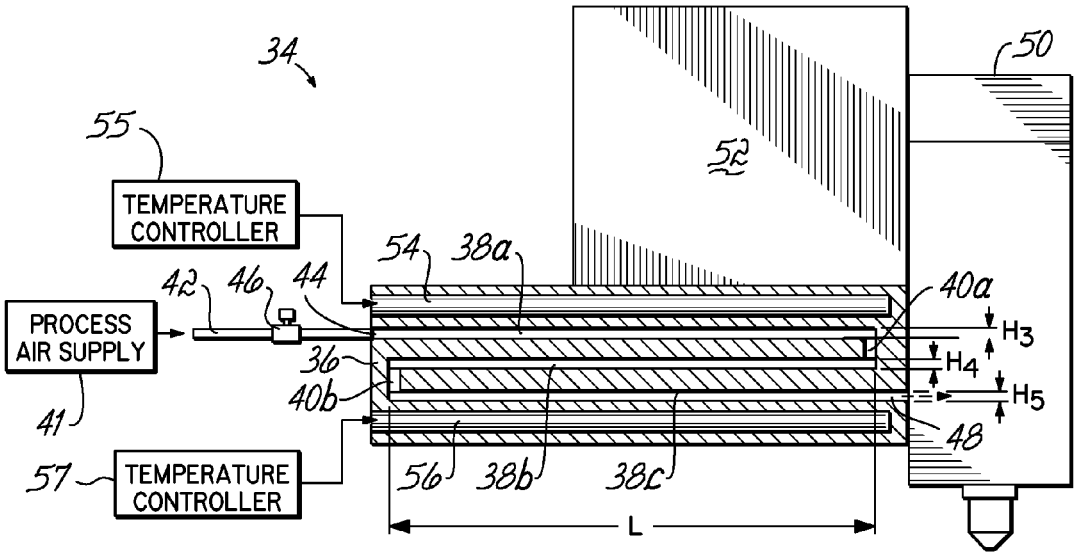
FIG. 3 is a schematic view of an adhesive dispensing system including a hot air module according to an embodiment of the invention.

With reference to FIG. 3, another embodiment of a hot air module or manifold 34 is diagrammatically shown which is constructed according to the principles of the invention. The hot air manifold 34 includes a body or metal block 36 and a plurality of, for example, three generally-parallel horizontal air passageways 38*a-c* divided from one another by a corresponding partition or dividing wall. Air passageway 38*a* is coupled to air passageway 38*b* by a vertical connecting or side passageway 40*a*, positioned at one end of the metal block 36. Similarly, air passageway 38*b* is coupled to air passageway 38*c* by a vertical connecting or side air passageway 40*b*, positioned at another end of metal block 36. Process air is provided to hot air manifold 34 from a process air supply 41 via a conduit 42, which is connected in fluid communication with an air inlet 44 at one open end of air passageway 38*a*. Air passageway 38*c* has an air outlet 48 coupled in fluid communication with a heated process air inlet of a dispensing module 50. Process air is typically supplied to air inlet 44 at a pressure ranging from 10 psi to about 100 psi and at approximately ambient temperature.

Figure 3A:
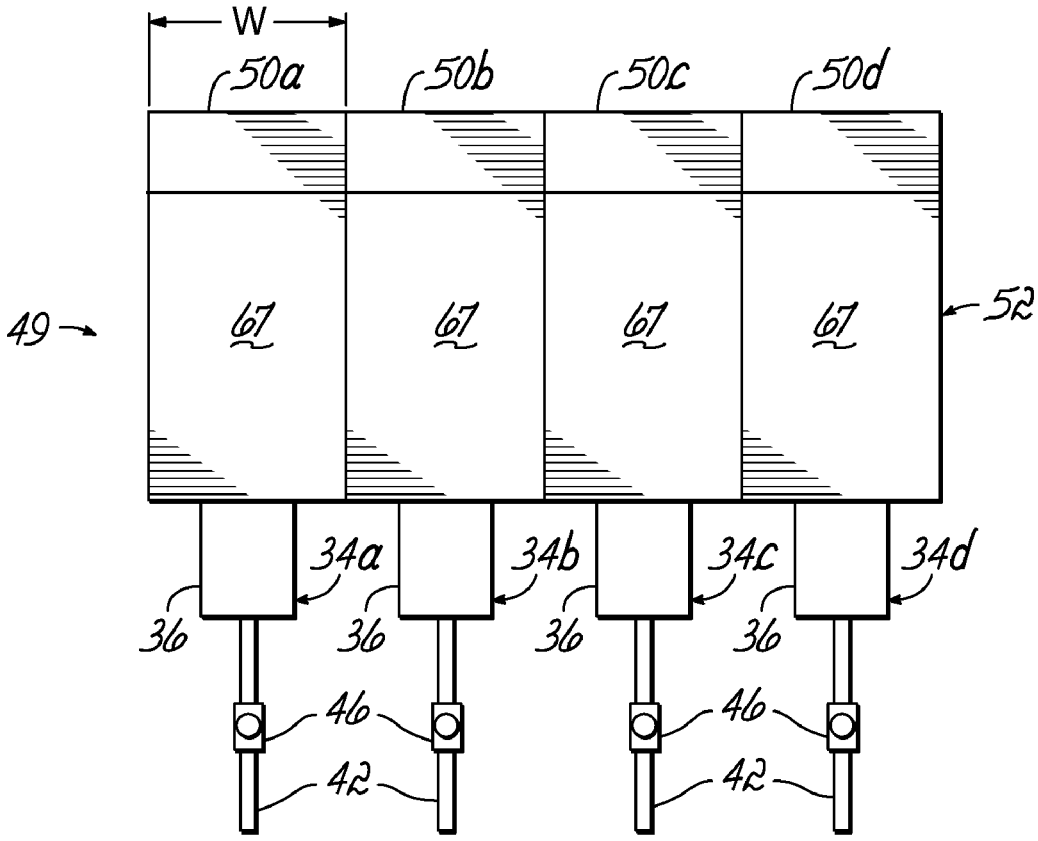
FIG. 3A is a schematic view of an adhesive dispensing system including a plurality of the hot air modules of FIG. 3.

A flow control device 46, such as a needle valve, may be provided in conduit 42 for controlling the flow rate and/or pressure of process air provided to air inlet 44. The flow control device 46 individualizes the control over the flow rate and/or air pressure of the process air applied to the dispensing module 50. As a result and as shown in FIG. 3A, a dispensing system 49 incorporating multiple dispensing modules 50*a-d* can likewise include multiple hot air manifolds 34*a-d* each having a flow control device 46 so that the flow rate and/or air pressure can differ for each of the dispensing modules 50*a-d*. A conventional non-modular dispensing system (not shown) may also benefit from hot air manifold 34 as the pressure and/or flow rate of process air to each of the dispensing modules 50*a-d* may be individually controlled. The compact size of the hot air manifold 34 facilitates its use as the space savings permit incorporation into modular or more conventional dispensing systems. For example, in certain modular dispensing systems, the dispensing modules 34*a-d* and modular adhesive manifold sections 67 have a width, W, of about 1 inch. One dimension of metal block 36 of the hot air manifolds 34*a-d* must be sized to accommodate this width.

Although not shown in FIG. 3, the dispensing module 50 is also coupled in fluid communication with an adhesive manifold 52 for receiving a flow of a heated adhesive, such as a hot melt adhesive, therefrom. The dispensing module 50 and the adhesive manifold 52 are conventional devices that operate according to known principles. For example, it is understood that the dispensing module 50 includes an internal adhesive passage having a discharge outlet and a valve assembly in the adhesive passageway that is operative to alternately permit and block the flow of adhesive from the discharge outlet to a substrate. Adhesive manifold 52 includes various internal passageways for receiving heated adhesive and distributing the heated adhesive, while maintaining its temperature, to various dispensing modules, such as dispensing module 50.

With continued reference to FIG. 3, the hot air manifold 34 further includes a pair of resistance cartridge heating elements or heaters 54, 56 positioned in metal block 36. It is appreciated that a flat heater, similar to flat heater 12 (FIG. 1), may be provided for use with hot air manifold 34 and, in certain embodiments, could provide the partitions between adjacent ones of air passageways 38*a-c*. The heaters 54, 56 are coupled with suitable temperature controllers 55, 57, which provide electrical energy for resistive conversion by the heaters 54, 56 into heat energy. The heat energy from the heaters 54, 56 is transferred to the metal block 36, which is heated to a temperature adequate to exhaust process air of a desired application temperature from air outlet 48. Heat energy is further transferred from the surfaces of the metal block 36 surrounding air passageways 38*a-c* and 40*a,b*, to process air flowing in those passageways. The air passageways 38*a-c* extend back and forth along the major dimension or length of the metal block 36 in a convoluted or folded shape or serpentine path. The convolution, folding or winding of the air passageways 38*a-c* back and forth along the length of the metal block 36 increases the effective path length for the process air inside the hot air manifold 34. The increased path length is achieved while minimizing the exterior dimensions of the metal block 36, so that the hot air manifold 34 is more compact than conventional hot air manifolds.

Each of the air passageways 38*a-c* is generally shaped as a parallelepiped open space having a rectangular cross-section when viewed normal to any face of the parallelepiped and having rectangular dimensions consisting of a length L, and a width extending into and out of the plane of the page of FIG. 3. Air passageway 38*a* has a vertical rectangular dimension or height, $H_3$, air passageway 38*b* has a height, $H_4$, and air passageway 38*c* has a height, $H_5$. Typically, each of the air passageways 38*a-c* has the same rectangular dimensions other than the extended lengths for the air inlet 44 and air outlet 48, although the invention is not so limited. For example, the respective heights may differ among the air passageways 38*a-c*. Each height, and length and width, is selected to provide efficient heat transfer with an acceptable pressure drop between the air inlet 44 and the air outlet 48. Given the magnitude of one dimension, the magnitudes of the remaining dimensions which satisfy these requirements may be calculated mathematically as indicated herein or may be determined empirically or experimentally. Typically, a pressure drop of less than about 10% of the pressure at the air inlet 44 is desired in the flow path between the air inlet 44 and air outlet 48. To achieve such performance with a length of less than about 5 inches and a width of less than about 1 inch, the height of each of the air passageways 38*a-c* should be in the range of about 5 mils to about 20 mils, and may be as large as about 30 mils.

In use and with reference to FIG. 3, heaters 54, 56 are energized for heating metal block 36 to a desired process temperature. Process air at an ambient temperature is admitted under pressure into air inlet 44 and flows along the length of metal block 36 in air passageway 38*a*. Transverse air passageway 40*a* redirects the process air and causes the process air to flow back along the length of the metal block 36 in the direction of air passageway 38*b*. Transverse air passageway 40*b* redirects the process air and causes the process air to flow back along the length of the metal block 36 in the direction of air passageway 38*c* to air outlet 48. As the process air passes through the air passageways 38*a-c*, it absorbs heat energy so as to obtain a desired application temperature at the air outlet 48. The dispensing module 50 uses the heated process air to heat the dispensing nozzle and, possibly, to manipulate a property of the discharged hot melt adhesive.

With reference to FIGS. 4, 5, 6 and 6A, an adhesive dispensing system 58 incorporating an alternative embodiment, according to the principles of the invention, of a hot air module or manifold 60 is illustrated. System 58 includes a pair of dispensing modules 62, 63, an adapter plate 64 disposed between the dispensing modules 62, 63 and the hot air manifold 60, a cartridge heater assembly 66, a modular manifold segment 67, and a conventional heated adhesive/air manifold (not shown). Dispensing module 62 is provided with a flow of heated hot melt adhesive and a flow of heated process air from a conventional heated adhesive/air manifold (not shown). Conventional fasteners and elastomeric seals (shown but unlabeled) are used to assemble the hot air manifold 60, the dispensing modules 62, 63, and the adapter plate 64. A temperature sensor 68, such as a resistance temperature detector, is provided in good thermal contact with the hot air manifold 60. The output signal from the temperature sensor 68 may be routed to a temperature controller (not shown) for regulating the power supplied to cartridge heater assembly 66.

Modular manifold segment 67 incorporates various internal distribution channels that provide respective flows of hot melt adhesive, heated process air, and actuation air to dispensing module 63, which is pneumatically actuated although the invention is not so limited. In particular, a gear pump (not shown), which is attached to an unfilled corner of modular manifold segment 67, pumps hot melt adhesive from a central supply passage 65 to a distribution passage 69 coupled in fluid communication with the dispensing module 63. Modular manifold segments 67 suitable for use in the invention are described, for example, in commonly-assigned U.S. Pat. No. 6,296,463, entitled "Segmented Metering Die for Hot Melt Adhesives or Other Polymer Melts," and U.S. Pat. No. 6,422,428 having the same title. It is appreciated that, as an attribute of the modular system design, an adhesive dispensing system may generally include multiple dispensing modules 63, as necessitated by the parameters of the dispensing application. Specifically, a plurality of modular manifold segments 67, each having a supply passage 65 and a distribution passage 69, may be interconnected in a side-by-side relationship in which the supply passages 65 are in fluid communication with each other and with a source of heated liquid, and each of the distribution passages 69 are in fluid communication with a corresponding dispensing module 63. Each of the modular manifold segments 67 and dispensing modules 63 may be associated with a corresponding hot air manifold 60 for providing an individual supply of heated process air relating to the heated liquid dispensed by each dispensing module 63. In such a configuration, each of the hot air manifolds 60 may individually tailor a characteristic of the heated process air, such as air temperature, air pressure or air flow rate, relating to the heated liquid dispensed to a corresponding dispensing module 63. In addition, the compact dimensions of hot air manifold 60 cooperate with the compact dimensions of the modular manifold segments 67 to provide a compact, modular dispensing system.

With continued reference to FIGS. 4, 5, 6 and 6A, the hot air manifold 60 includes a set of pivoting clamps 70, 72 and a flanged projection 74 that cooperate for releasably attaching a pair of nozzles 73*a*, 73*b* each receiving and discharging an intermittent flow of hot melt adhesive from a corresponding one of the dispensing modules 62, 63. To that end, hot air manifold 60 includes an adhesive passageway 71 providing a fluid path capable of transferring heated hot melt adhesive from the dispensing module 62 to nozzle 73*b* and four air ports 75 providing a flow of heated process air to the nozzle 73*b*, in which the heated process air is used to manipulate the dispensed hot melt adhesive and/or to heat nozzle 73*b*. Heated liquid and heated process air are provided to dispensing module 62 from the conventional heated adhesive/air manifold, although the invention is not so limited in that, instead, a second modular manifold segment 91 (FIG. 4A) identical to modular manifold segment 67 may be provided for supplying at least heated liquid to dispensing module 62. The hot air manifold 60 may be modified to cooperate with the second modular manifold segment 91 for providing heated process air in accordance with the principles of the invention to nozzle 73*b*.

Hot air manifold 60 also includes an adhesive passageway 76 capable of transferring heated hot melt adhesive dispensed from dispensing module 63 to nozzle 73*a*. Adhesive passageway 76 receives hot melt adhesive through a slotted adhesive inlet 77 formed in a generally-planar upper surface 78 of the hot air manifold 60 and routes the hot melt adhesive to an adhesive outlet 80. The nozzle 73*a* includes an adhesive passageway 79 coupled in fluid communication with adhesive passageway 76 and terminating in an outlet 79*a* for discharging the hot melt adhesive.

Figure 4:
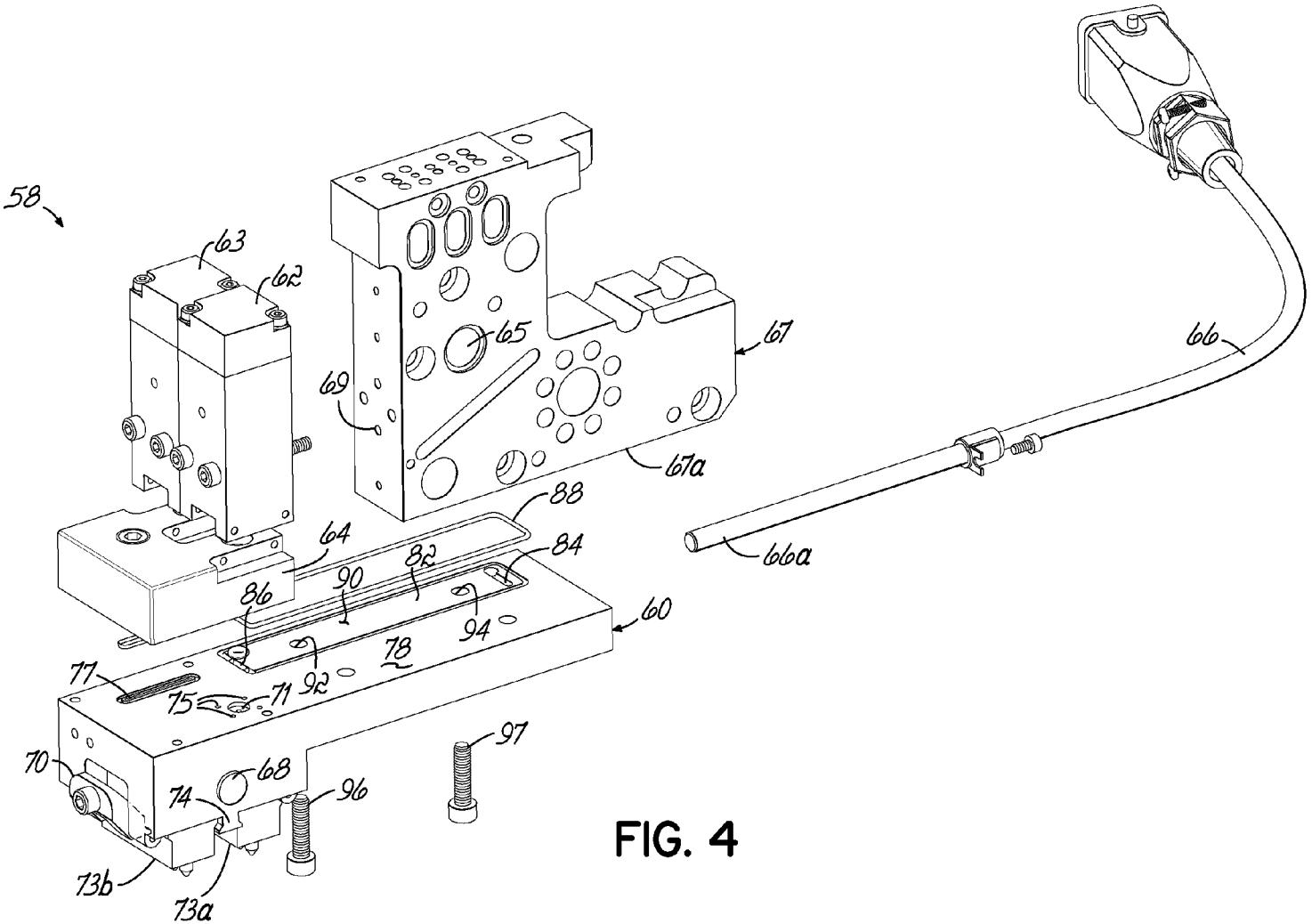
FIG. 4 is an exploded view of an alternative embodiment of an adhesive dispensing system including a hot air module according to an embodiment of the invention.
Figure 4A:
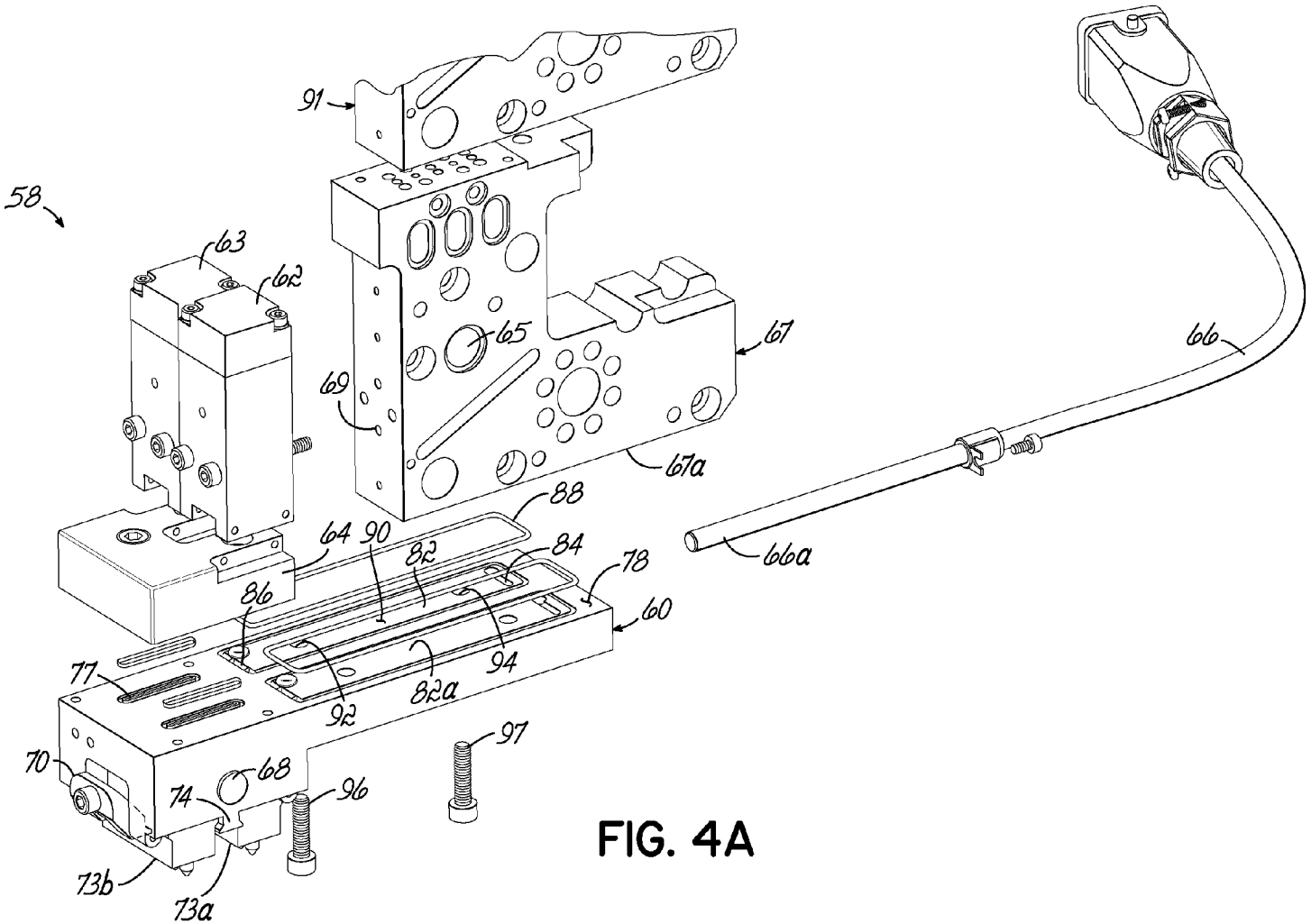
FIG. 4A is an exploded view similar to FIG. 4 of an adhesive dispensing system including a hot air module in accordance with an alternative embodiment.

With continued reference to FIGS. 4, 5, 6 and 6A, the hot air manifold 60 is machined from a metal block and includes a shallow recess 82 in upper surface 78 providing a flow path through which process air is routed from a slotted air inlet 84 to a slotted air outlet 86. The slotted shapes of air inlet 84 and air outlet 86 improve the flow distribution of process air across the width of recess 82. A sealing gasket or O-ring 88 is provided in a suitably dimensioned O-ring groove or gland 89 that encircles the shallow recess 82. When the modular manifold segment 67 is mounted to hot air manifold 60, a bottom surface 67*a* of modular manifold segment 67 covers the shallow recess 82 and provides a sealing engagement with O-ring 88 and thereby contributes to making recess 82 substantially pressure-tight. It is contemplated by the invention that the hot air manifold 60 may be equipped with another shallow recess 82*a*, similar to shallow recess 82, according to the principles of the invention, and as shown in FIG. 4A, so that the hot air manifold 60 can be associated with two modular manifold sections 67, 91.

Figure 5:
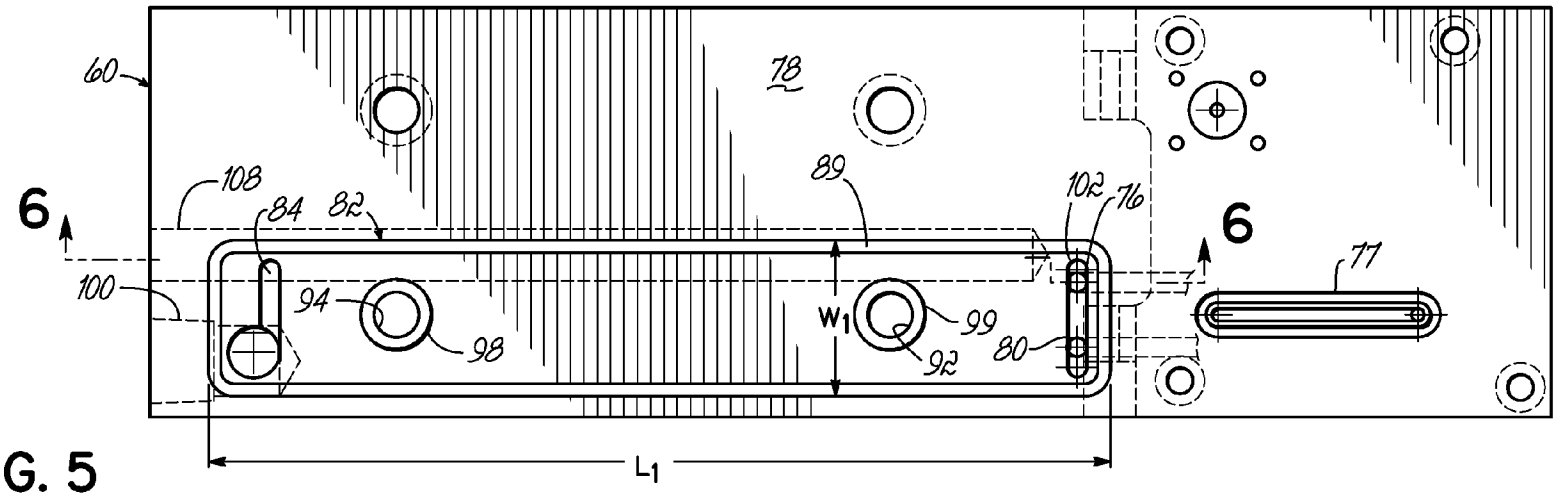
FIG. 5 is a top perspective view of the hot air module of FIG. 4.
Figure 6:
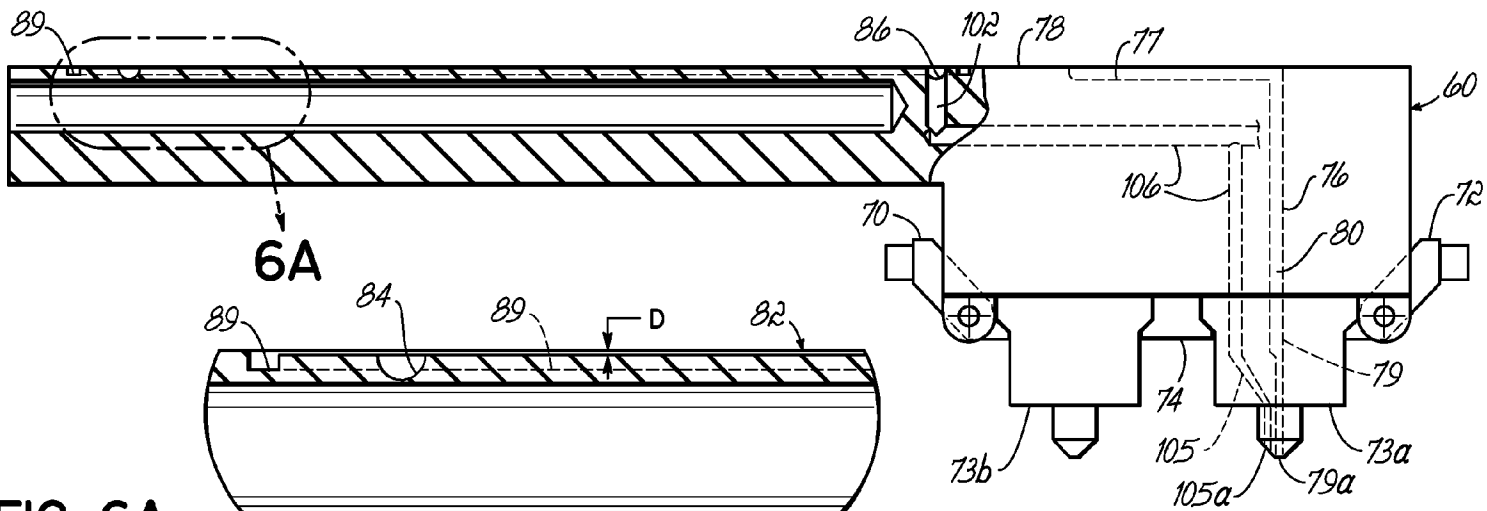
FIG. 6 is a cross-sectional view taken generally along line 6-6 in FIG. 5.
Figure 6A:
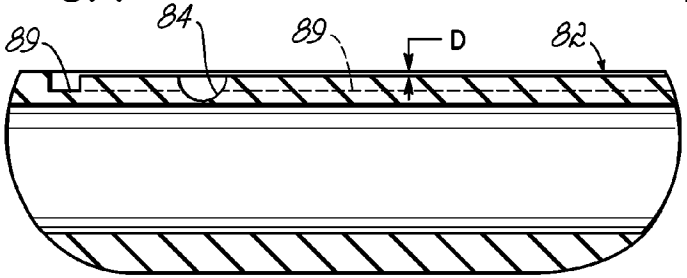
FIG. 6A is an enlarged perspective view partially broken away of FIG. 6.

With reference to FIGS. 5, 6 and 6A in which the hot air manifold 60 is shown in greater detail, shallow recess 82 is recessed in relief relative to the adjacent surrounding portions of surface 78. Penetrating through a rear surface of the hot air manifold 60 are two bolt holes 92, 94 that emerge in a floor surface 90 of the recess 82. When fasteners 96, 97 (FIG. 4) are positioned in bolt holes 92, 94, sealing washers 98, 99 (FIG. 5) are provided in countersunk recesses surrounding each bolt hole 92, 94 and other sealing accommodations, such as sealing compound or TEFLON® tape on the threads of fasteners 96, 97, are provided so that the recess 82 has an air-tight seal. The fasteners 96, 97 extend though the recess 82 for coupling or mating the modular manifold segment 67 with the hot air manifold 60. It is contemplated by the invention that the bolt holes 92, 94 may be positioned outside of the periphery of recess 82 and the O-ring gland 89 so that a length of the fasteners 96, 97 does not partially obstruct or occlude the air plenum defined by recess 82.

Air inlet 84 is connected by an air passageway 100 with a source of process air (not shown). Air outlet 86 includes two air openings 102, 104 near opposite ends of a slot or recess 82 recessed beneath the floor surface 90 that helps to channel the heated process air into the air openings 102, 104. The air openings 102, 104 provide the heated process air to a corresponding pair of process air passageways 106, of which one is shown, that direct the heated process air to a process air passageway 105 in nozzle 73*a*. The heated process air heats the dispensing nozzle to ensure proper dispensing and may be emitted from an outlet 105*a* of process air passageway 105 for, possibly, manipulating a property of the discharged hot melt adhesive.

An elongate, open-ended chamber 108 is provided in hot air manifold 60 for receiving a cartridge heating element 66*a* of cartridge heater assembly 66. Heat is transferred from the cartridge heating element 66*a* to the metal forming the hot air manifold 60 and, subsequently, is transferred by the surfaces defining recess 82 to process air flowing in shallow recess 82 from air inlet 84 to air outlet 86.

With continued reference to FIGS. 5, 6 and 6A, the separation between a bottom surface 67*a* of modular manifold segment 67 (FIG. 4) and the confronting floor surface 90 of the recess 82 determines the height of the air passageway or air plenum provided by recess 82. In the discussion that follows, the height of the air plenum is described in terms of the depth of the recess 82, which is defined when modular manifold segment 67 (FIG. 4) is attached to hot air manifold 60. Accordingly, bottom surface 67*a* and top surface 78 are considered to be coextensive and the presence of sealing ring 88 is presumed to not provide a significant contribution to the effective height of the air plenum when modular manifold segment 67 is in position to close the air plenum, although the invention is not so limited.

Recess 82 is generally shaped as a parallelepiped open space having a rectangular cross-section, when viewed normal to any face of the parallelepiped, and having rectangular dimensions consisting of a length $L_1$, a width $W_1$, and a depth, D. The rectangular dimensions of recess 82 are selected to provide efficient heat transfer with an acceptable pressure drop between the air inlet 84 and the air outlet 86. If a value of, for example, the width of the recess 82 is selected, a depth and a length satisfying these requirements may be calculated numerically as indicated below or may be determined empirically or experimentally. Typically, a pressure drop of less than about 10% of the pressure at the air inlet 84 is desired in the flow path between the air inlet 84 and air outlet 86. To achieve such performance with a length of less than about 5 inches and a width of less than about 1 inch, the depth of the recess 82 should generally be in the range of about 5 mils to about 20 mils, and may be as large as about 30 mils. Generally, the heat transfer rate from the inwardly-facing surfaces of recess 82 to the process air flowing in the recess 82 increases with decreasing depth, and the pressure drop through the recess 82 also increases with decreasing depth. The increased pressure drop may be offset by increasing the length and width of the recess 82.

According to the principles of the invention, the flow path for process air in the air passageway or air plenum of a hot air manifold, such as one of the hot air manifolds 10, 34 and 60, may be modeled to predict a set of optimized dimensions that promotes efficient heat transfer from the manifold to the circulating process air and that minimizes the pressure drop in the air plenum or air passageway between the air inlet and the air outlet. In particular, the physical behavior of the hot air manifold may be approximated by solving appropriate heat transfer and pressure drop equations mathematically to simulate the performance of the hot air manifold. Input parameters may be varied to study the approximated physical behavior.

The heat transfer and pressure drop equations are solved numerically by suitable software applications, such as MATHCAD® (Mathsoft, Inc., Cambridge, Mass.), implemented on a suitable electronic computer or microprocessor, which is operated so as to perform the physical performance approximation. The software application MATHCAD® internally converts all units to a common or consistent set of units, such as SI metric units or English units, as understood by a person of ordinary skill in the art. A set of initial conditions is defined by assigning initial values to the variables and assigning numeric values to the constants. The equations are then solved numerically to provide a set of optimized dimensions for the flow path of process air in the hot air manifold. Specifically, required length of the flow path and pressure drop are determined for a given flow path width and depth to achieve a desired temperature for the output process air. The pressure drop increases slightly when the flow path is folded or convoluted to provide a multi-segment path consisting of a plurality, n, of segments. It is contemplated that the model of the flow path for process air in the air passageway or air plenum of the hot air manifold and the numerical solution for optimized dimensions may account for obstructions or occlusions in the flow path. For example, the model may be modified to include piecewise continuous flow paths having differing dimensions.

The system of equations and a sample set of input parameters are provided by the following description.

Input Parameters

Dimensions

Length $L_1$=L:=5·in

Depth $H_1$=L1:=0.02·in

Width $W_1$=L2:=0.875·in

Inlet Temperature t1:=70

Outlet Temperature t2:=375 degrees Fahrenheit

Manifold Temperature $t_{heat}$:=400 degrees Fahrenheit

Standard Air Mass Conversion $$SCF := \frac{1 \cdot ft^3 \cdot 29 \cdot gm}{22.41410 \cdot liter}$$

Kinematic Viscosity of Air $$\mu := .0426 \cdot \frac{lb}{hr \cdot ft}$$

$\mu=1.761\times10^{-4}$ poise

Surface Roughness $\epsilon$:=0.001·in

Number of Channels n:=1

Specific Heat $$Cp := .241 \cdot \frac{BTU}{lb \cdot R}$$

Average Pressure $P_{avg}$:=35·psi

Required Flow $$flow := 2 \cdot \frac{SCF}{min}$$

$$flow(n) := \frac{flow}{n}$$

flow per parallel channel, for n channels

Equivalent Geometrical Diameter $$d(L1, L2) := \frac{2 \cdot L1 \cdot L2}{L1 + L2}$$

d(L1,L2):=0.039 in

Equivalent Hydraulic Diameter $$de(L1, L2) := 2 \cdot \sqrt{\frac{L1 \cdot L2}{\pi}}$$

de(L1,L2)=0.149 in

LeqD:=0 Equivalent Length with bends etc.

dc(L1):=L1 Circular hydraulic diameter

Inlet to Outlet Temperature Difference

Δt:=t2−t1

Mean Temperature to be Used for all Bulk Fluid Calculations $$tm := \frac{t1 + t2}{2}$$

tm=222.5

$$C := \frac{351 + 0.1583tm}{10^5}$$

$c=3.862\times10^{-3}$ per Chemical Engineering Reference Manual, eq. 7.20, pg. 7-5

$C=0.01444\cdot0.241=3.48\times10^{-3}$ Perry's Chemical Engineers' Handbook, pg. 10-14, eq.10-53

$$\rho_{avg} := \frac{29 \cdot gm}{22.41410 \cdot liter} \cdot \frac{P_{avg}}{atm} \cdot \frac{32 + 460}{tm + 460}$$

Air density as a function of mean temperature & average pressure

Log Mean Temperature Difference ($\Delta t_{lm}$)

$$\Delta t_{lm} := \frac{(t_{heat} - t1) - (t_{heat} - t2)}{\ln\left(\frac{t_{heat} - t1}{t_{heat} - t2}\right)} \cdot R$$

$\Delta t_{lm}$=118.207 R

Cross section & Surface area $A_{cross}(L1,L2):=L1 \cdot L2$ $A_{surface}(L1,L2,L):=L \cdot 2 \cdot (L1+L2)$ $A_{cross}(L1,L2)=0.018\ in^2$ $A_{surface}(L1,L2,L)=8.95\ in^2$ Mass Velocity $$G(L1, L2, n) := \frac{\text{flow}(n)}{A_{cross}(L1, L2)} \cdot \frac{hr \cdot \text{ft}^2}{\text{lb}}$$

$G(L1,L2,n)=7.976\times10^4$

Reynolds Number $$Re(L1, L2, n) := \frac{\left(\frac{d(L1, L2)}{\text{ft}}\right) \cdot G(L1, L2, n)}{\mu} \cdot \frac{\text{lb}}{hr \cdot \text{ft}}$$

$Re(L1,L2,n)=6.101\times10^3$

Heat Transfer Coefficient $$h(L1, L2, n) := \frac{C \cdot G(L1, L2, n)^{0.8}}{\left(\frac{d(L1, L2)}{\text{ft}}\right)^{0.2}} \cdot \frac{\text{BTU}}{hr \cdot \text{ft}^2 \cdot R}$$

$$h(L1, L2, n) = 101.3 \frac{\text{BTU}}{hr\text{ft}^2 \cdot R}$$

$q(L1,L2,L,n):=h(L1,L2,n) \cdot A_{surface}(L1,L2,L) \cdot \Delta t_{lm}$ $q(L1,L2,L,n)=218.127$ watt $$t_{out}(L1, L2, L, n) := \frac{q(L1, L2, L, n)}{\text{flow}(n) \cdot Cp \cdot R} + t1$$

$t_{out}(L1,L2,L,n)=388.627°$ F.

$$dg := .001 \cdot \text{in}, .002 \cdot \text{in} \ldots \frac{1}{2} \cdot \text{in}$$

$Lf(L1,L2,n):=root[(t_{out}(L1,L2,L,n)-t2),L]$ $Lf(L1,L2,n)=4.786$ in

Pressure Drop Equations Churchill Friction Factor $$A(L1, L2, n) := \left[2.457 \cdot \ln\left[\frac{1}{\left(\frac{7}{Re(L1, L2, n)}\right)^{.9} + .27 \cdot \frac{\varepsilon}{de(L1, L2)}}\right]\right]^{16}$$

$$B(L1, L2, n) := \left(\frac{37530}{Re(L1, L2, n)}\right)^{16}$$

$$ff(L1, L2, n) := 8 \cdot \left[\left(\frac{8}{Re(L1, L2, n)}\right)^{12} + \frac{1}{(A(L1, L2, n) + B(L1, L2, n))^{\frac{3}{2}}}\right]^{\frac{1}{12}}$$

$ff(L1,L2,n)=0.044$

Average Air Pressure $P_{avg}$=35 psi $$\Delta P(L1, L2, n) := ff(L1, L2, n) \cdot \left(\frac{Lf(L1, L2, n)}{de(L1, L2)} + LeqD\right) \cdot \frac{1}{2 \cdot \rho_{avg}} \cdot \left(\frac{4 \cdot \text{flow}(n)}{\pi \cdot de(L1, L2)^2}\right)^2$$

For:

L1=0.02 in

L2=0.875 in $Lf(L1,L2,n)=4.786$ in n=1

$\Delta P(L1,L2,n)=0.536$ psi

For:

$L1:=0.01 \cdot in$ $Lf(L1,L2,n)=2.426$ in $\Delta P(L1,L2,n)=1.614$ psi

Desired Air Temperature (° F.)

t2=375

Heater Temperature (° F.)

$t_{heat}$=400

Air Flow $$\text{flow}(1) = 2\frac{SCF}{\text{min}}$$

Power Required $q(L1,L2,Lf(L1,L2,n),n)=209$ watts

In the preceding description, the average pressure, $P_{avg}$, represents the average of the pressure at the air inlet and the pressure at the air outlet. The pressure drop equations in the preceding description originate from a journal article entitled "Friction-factor Equation Spans All Fluid Flow Regimes" authored by Stuart W. Churchill and published in *Chemical Engineering*, Nov. 7, 1977, pp. 91-92. All heat transfer equations in the preceding description are derived from *Perry's Chemical Engineers' Handbook*, McGraw-Hill 5$^{th}$ Edition (1973) and *Chemical Engineering Reference Manual*, Professional Publications, Inc., 5th Edition (1996).

Figure 7:
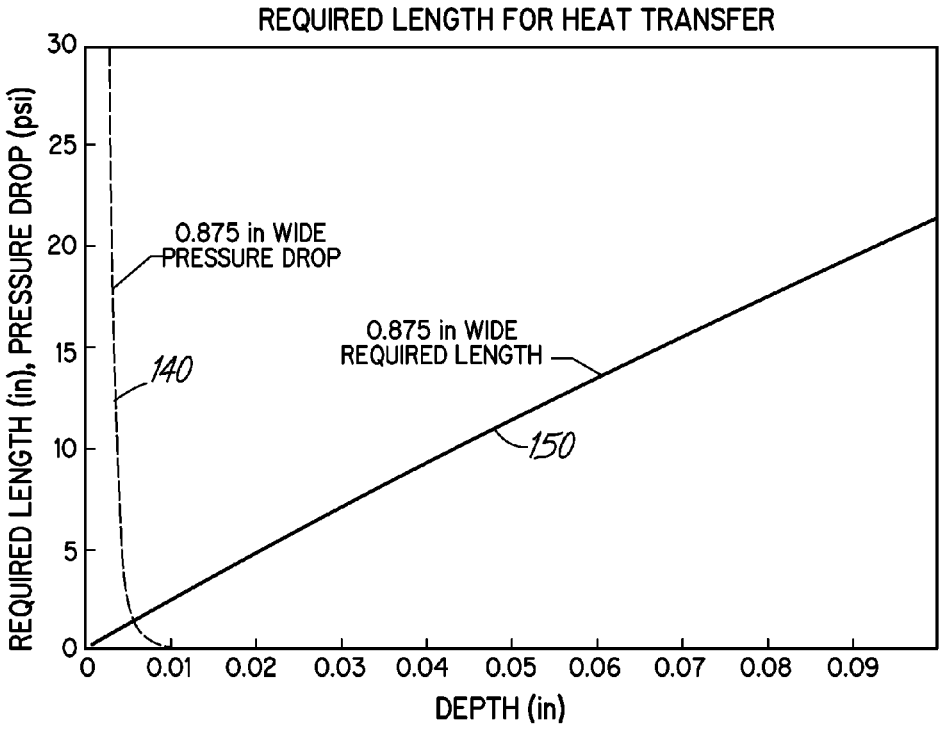
FIG. 7 is a graphical representation of the required flow path length and pressure drop as a function of the depth of the recess.

With reference to FIG. 7, a graphical representation is provided of the required flow path length and pressure drop in the flow path as respective functions of the depth for a 0.875 inch wide flow path. The flow path length is indicated by a line on FIG. 7 labeled with reference numeral 140 and the pressure drop is indicated by a line on FIG. 7 labeled with reference numeral 150. The calculations that provided the information presented in FIG. 7 considered a flow path having a single segment path such as shown in FIGS. 4, 5, 6 and 6A. The system of equations was solved by the numerical calculations described hereinabove for various sets of initial conditions, similar to the single set of initial conditions provided above.

Typically, a pressure drop of less than about 10% is desired in the flow path between the air inlet and air outlet. Generally, to achieve such performance for a length of less than about 5 inches and a width of less than about 1 inch, the recess depth should be in the range of about 5 mils to about 20 mils. However, the invention is not so limited and the recess depth will depend upon length and width, among other variables.

As is apparent from FIG. 7, the pressure drop decreases dramatically as the recess depth increases from about 0.005 inches to about 0.01 inches. For example, a recess depth of about 0.01 inches requires a length for the flow path of about 2.5 inches and results in a pressure drop of about 1.6 psi for an air pressure at the inlet of 35 psi. The required heat flow from the heater is determined to be about 209 watts for a process air flow of 2 standard cubic feet per minute (SCFM) to provide an air temperature at the air outlet of 375° F. and a heater temperature of 400° F. For these same conditions, a recess depth of about 0.02 inches requires a length for the flow path of about 4.8 inches and results in a pressure drop of about 0.5 psi.

According to the principles of the invention, the dimensions of the hot air manifold are minimized for space savings and, to that end, the length of the flow path may be selected from the calculation that provides an acceptable pressure drop and that will concomitantly minimize the dimensions of the hot air manifold. For example and with reference to FIG. 7, if a pressure drop of 1.6 psi is acceptable, the hot air manifold need only be dimensioned to accommodate a flow path as a single-pass recess having a depth of 0.01 inches, a width of 0.875 inches and a length of about 2.5 inches. However, if a smaller pressure drop of, for example, 0.5 psi is required for the particular dispensing application, the dimensions of the hot air manifold must increase to accommodate a lengthened flow path as a recess now having a depth of 0.02 inches and a length of about 4.8 inches, if the width of 0.875 inches remains constant. Generally, for a constant pressure and flow rate of process gas, the requisite depth and length of the flow path for providing a desired pressure drop will increase with decreasing width of the recess.

As is apparent from FIG. 7, the recess may have a length greater than 5 inches if the recess depth is correspondingly increased so that the hot air manifold can transfer sufficient heat energy to heat the process air flowing though the recess to a desired air temperature at the air outlet and so that the pressure drop is minimized. Although the invention has general applicability, the hot air modules are best constructed so as to be space preserving and, in particular, to permit use with heated liquid and adhesive dispensing systems assembled from modular adhesive manifolds that require space conservation.

It is appreciated by a person of ordinary skill that the optimized dimensions for the recess determined from the numerical solution of the model may be used as a basis for subsequent empirical measurements based on experiment or observation that adjust the optimized dimensions for physical behavior of the hot air manifold only approximated by the model. It is also appreciated by a person of ordinary skill in the art that a set of optimized dimensions may be determined empirically based on observation or experience rather than by numerical solution of a model approximating the physical behavior of the hot air manifold.

While the invention has been illustrated by a description of various preferred embodiments and while these embodiments have been described in considerable detail in order to describe the best mode of practicing the invention, it is not the intention of the applicant to restrict or in any way limit the scope of the appended claims to such detail. Additional advantages and modifications within the spirit and scope of the invention will readily appear to those skilled in the art.

The invention itself should only be defined by the appended claims, wherein we claim:

1. A dispensing system for dispensing a heated liquid onto a substrate, comprising:

a hot air manifold including a first surface, a second surface recessed in said first surface to define an air plenum for process air, a first passageway defining an inlet for supplying the process air to said air plenum, and a second passageway defining an outlet for removing the process air from said air plenum;

a liquid manifold capable of supplying heated liquid, said liquid manifold including a surface confronting said first and second surfaces of said hot air manifold, and said surface of said liquid manifold separated from said second surface of said hot air manifold by a distance ranging from about 5 mils to about 30 mils to define a height of said air plenum;

a dispensing module coupled in fluid communication with said liquid manifold and in fluid communication with said air outlet of said hot air manifold, said dispensing module capable of dispensing the heated liquid received from said liquid manifold onto the substrate, and said dispensing module capable of receiving the process air from said second passageway of said hot air manifold and dispensing the process air to impinge upon the heated liquid; and a heating element operative for heating the process air flowing through said air plenum from said inlet to said outlet.

2. The dispensing system of claim 1 wherein said surface of said liquid manifold is configured to transfer heat from said heating element to the process air flowing through said air plenum from said inlet to said outlet.

3. The dispensing system of claim 1 wherein said air plenum has a pressure drop between said inlet and said outlet of less than about 10% of an initial air pressure at said inlet.

4. The dispensing system of claim 1 wherein said surface of said liquid manifold and said second surface of said hot air manifold are planar.

5. The dispensing system of claim 1 wherein said heating element is coupled to said hot air manifold, and said second surface of said hot air manifold is configured to transfer heat from the heating element to the process air flowing through said air plenum from said inlet to said outlet.

6. A dispensing system for dispensing a heated liquid onto a substrate, comprising:

a plurality of hot air manifolds, each of said hot air manifolds including a first surface, a second surface recessed in said first surface to define an air plenum for process air, a first passageway defining an inlet for supplying the process air to said air plenum, and a second passageway defining an outlet for removing the process air from said air plenum;

a plurality of manifold segments, each of said manifold segments having a supply passage and a distribution passage coupled with said supply passage, each of said manifold segments configured to supply the heated liquid from said supply passage to said distribution passage, said manifold segments being interconnected in side-by-side relationship so that said supply passages are in fluid communication, each of said manifold segments including a surface confronting said first and second surfaces of a respective one of said hot air manifolds, and said surface of said manifold segment separated from said second surface of said hot air manifold by a distance ranging from about 5 mils to about 30 mils to define a height of said air plenum; and a plurality of dispensing modules, each of said dispensing modules coupled in fluid communication with said distribution passage of a respective one of said manifold segments and in fluid communication with said outlet of a respective one of said hot air manifolds, each of said dispensing modules capable of dispensing the heated liquid received from the respective one of said manifold segments onto the substrate, and each of said dispensing modules capable of receiving the process air from said second passageway of the respective one of said hot air manifolds and dispensing the process air to impinge upon the heated liquid; and a plurality of heating elements each operative for heating the process air flowing through said air plenum of a respective one of said hot air manifolds from its air inlet to outlet.

7. The dispensing system of claim 6, wherein each of said air plenums has a pressure drop between its inlet and outlet of less than about 10% of an initial air pressure at its inlet.

8. The dispensing system of claim 6 wherein said surface of each of said liquid manifolds is configured to transfer heat from a respective one of said heating element to the process air flowing through a respective one of said air plenum from its inlet to outlet.

9. The dispensing system of claim 6 wherein each of said heating elements is coupled to a respective one of said hot air manifolds, and said second surface of each of said hot air manifolds is configured to transfer heat from a respective one of said heating elements to the process air flowing through a respective one of said air plenums from its inlet to outlet.

10. The dispensing system of claim 6 wherein said surface of each of said liquid manifolds is planar, and said second surface of each of said hot air manifolds is planar.

* * * * *

UNITED STATES PATENT AND TRADEMARK OFFICE

CERTIFICATE OF CORRECTION

PATENT NO. : 8,286,833 B2
APPLICATION NO. : 12/884538
DATED : October 16, 2012
INVENTOR(S) : Laurence B. Saidman et al.

It is certified that error appears in the above-identified patent and that said Letters Patent is hereby corrected as shown below:

Col. 5, line 55, "dispensing module is" should be -- dispensing modules are --

Col. 7, line 4, "to aide in defining" should be -- to aid in defining --

Col. 17, line approx. 55, "applicant to restrict" should be -- applicants to restrict --

Claim 8, Col. 20, line 1, "element to the process air flowing through a respective one of said air plenum" should be -- elements to the process air flowing through a respective one of said air plenums --

Signed and Sealed this
Twenty-second Day of January, 2013

David J. Kappos

David J. Kappos
*Director of the United States Patent and Trademark Office*